US006762356B2

(12) United States Patent
McNab et al.

(10) Patent No.: US 6,762,356 B2
(45) Date of Patent: Jul. 13, 2004

(54) SYSTEM FOR TURNING PAGES OF A MATERIAL

(75) Inventors: Cornelius S McNab, New Haven, CT (US); Darryl T Rathbun, Stratford, CT (US); Denis A. Stemmle, Stratford, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/206,581

(22) Filed: Jul. 26, 2002

(65) Prior Publication Data

US 2004/0016337 A1 Jan. 29, 2004

(51) Int. Cl.[7] ..... G10G 7/00

(52) U.S. Cl. ..... 84/486; 84/487; 84/489; 84/490; 84/496; 84/500; 84/507; 84/513

(58) Field of Search ..... 84/486, 487, 489, 84/490–493, 495, 496, 500, 501, 502, 507, 513

(56) References Cited

U.S. PATENT DOCUMENTS

| | | | | |
|---|---|---|---|---|
| 4,693,594 A | | 9/1987 | Garavuso et al. | 355/25 |
| 4,942,482 A | | 7/1990 | Kakinuma et al. | 358/474 |
| 5,084,732 A | | 1/1992 | Tsaur et al. | 355/230 |
| 5,286,956 A | | 2/1994 | Mochizuki | 235/432 |
| 5,325,213 A | | 6/1994 | Takahashi et al. | 358/474 |
| 5,390,033 A | | 2/1995 | Bannai et al. | 358/498 |
| 5,471,277 A | | 11/1995 | Fujioka et al. | 355/25 |
| 5,572,284 A | | 11/1996 | Fujioka | 299/362 |
| 5,575,097 A | | 11/1996 | Chou et al. | 40/531 |
| 5,583,607 A | | 12/1996 | Fujioka et al. | 355/25 |
| 5,583,662 A | | 12/1996 | Takahashi et al. | 358/474 |
| 5,610,720 A | | 3/1997 | Fujioka et al. | 358/296 |
| 5,794,365 A | * | 8/1998 | Hindermeyer et al. | 40/476 |
| 5,798,841 A | | 8/1998 | Takahashi | 358/296 |
| 5,854,670 A | | 12/1998 | Yong | 355/25 |
| 5,962,801 A | | 10/1999 | Bowman et al. | 84/486 |
| 6,049,033 A | | 4/2000 | Dallas | 84/486 |
| 6,055,036 A | | 4/2000 | Takahashi | 355/25 |
| 6,075,624 A | | 6/2000 | Bannai et al. | 358/498 |
| 6,103,963 A | | 8/2000 | Nakamura et al. | 84/486 |
| 6,281,990 B1 | | 8/2001 | Takahashi | 358/474 |
| 6,457,398 B1 | * | 10/2002 | Wong | 89/486 |

FOREIGN PATENT DOCUMENTS

| | | | |
|---|---|---|---|
| FR | 2680723 | * | 3/1993 |

* cited by examiner

*Primary Examiner*—Shih-yung Hsieh
(74) *Attorney, Agent, or Firm*—Charles R. Malandra, Jr.; Angelo N. Chaclas

(57) ABSTRACT

The present invention relates to using transparent page turning sheets or discs that are inserted into pages of a book or other material to turn selected pages of the book or material. Data from the pages may be recorded and/or reproduced by an associated photocopier, computer or printer device.

15 Claims, 7 Drawing Sheets

SYSTEM FOR TURNING PAGES OF A MATERIAL

BACKGROUND

1. Field of the Invention

The present invention relates generally to manipulating pages of a material. This includes turning pages of a material and obtaining data from the material. More particularly, the invention relates to a method and apparatus that enables the pages or leaves of the material to be turned so that the data thereon may be recorded by a data obtaining mechanism with minimal image distortion and degradation.

2. Brief Description of the Art

Photocopying multiple pages from materials, such as, for example, reference books, newspapers, periodicals, pamphlets and magazines, is a difficult and cumbersome process. Conventional photocopying machines are designed to copy flat materials. Present methods of photocopying pages from a material such as a book, involve placing the open book face-down on the glass platen surface of a photocopier or scanning device, pressing down on the spine of the book, pressing the Print/Copy button to scan and/or photocopy, and waiting a few seconds for the page to be reproduced.

One disadvantage to the conventional approach is that the book or material to be photocopied must be lifted, the page turned manually, and the process repeated for each page that is to be photocopied. This allows the copying of one or two pages at a time, depending on the size of the book relative to the photocopying surface. Thus, the photocopying process is cumbersome when photocopying numerous pages from a material, especially when performing research that requires photocopying a large number of pages from periodicals, because typically periodicals are not allowed to be checked out of a library.

Another disadvantage to the conventional photocopying approach is that it often results in damage to the material from repeated manipulation and handling, and the pressure placed on the spine of the material during the photocopying process.

Yet another disadvantage to the conventional approach is that it may result in distorted photocopies when the material to be copied is not pressed firmly against the platen.

Yet another disadvantage to the conventional approach is that it is very tiresome, inefficient, and time-consuming.

What is needed to overcome drawbacks in the state of the art is a method and apparatus for efficiently turning pages of a material to permit recording and reproducing distortion-free images from the material without damaging the material.

BRIEF SUMMARY OF THE INVENTION

The instant invention provides a solution to the above-noted problems by providing a method and apparatus that records and reproduces multiple pages or leaves from the material with minimal image distortion and degradation.

The method and apparatus of the present invention may be used in a stand-alone fashion or, alternatively, may be built as an attachment to conventional photocopiers, printers, computers, facsimiles, or other machine that is capable of recording, reproducing, transmitting, or storing printed or electronic data.

Accordingly, one embodiment of the present invention is directed to an apparatus for turning leaves of a material such as a book that has a plurality of leaves or pages. This embodiment uses two leaf turning members, one to turn the page and one to hold the material in position. Specifically, the apparatus includes a plurality of transparent leaf turning sheet pairs, each transparent leaf turning sheet pair has a first transparent leaf turning sheet and a second transparent leaf turning sheet. The transparent leaf turning sheet pair is inserted between two leaves of the material prior to initiating a leaf turning operation. A support member is connected to a corresponding transparent leaf turning sheet member, each support member is adapted to support the associated transparent leaf turning sheet member. A drive unit, or motor is adapted to move one or more of the support members from a first position to a second position, thereby turning one of the transparent leaf turning sheet members of a pair so that the first transparent leaf turning sheet member turns a first leaf of the material and the second transparent leaf turning sheet member is in contact with a second leaf of the material. Optionally, a data-obtaining unit records data from an exposed leaf or pair of leaves of the material.

Another embodiment of the present invention is directed to a method and apparatus for turning leaves or pages of a material such as a book. The method and apparatus includes one or more support members, each member having a base. A pivoting mechanism is positioned at the base and pivots the support member 180 degrees in a first direction. One or more transparent page turning leaves is connected to the support member by a connection mechanism, the connection mechanism permits the transparent leaf to pivot approximately 180 degrees in a second direction that is opposite to the first direction.

Another embodiment of the present invention is directed to an apparatus and method for turning pages of a material. The apparatus and method include a plurality of sheet members, each sheet member moves a leaf, which contains data. A support member is connected to a corresponding sheet member. A motor unit or drive unit moves each of the support members from a first position to a second position, the first position being different than the second position. Optionally, a data-obtaining unit may be used to record data from an exposed leaf. The apparatus may also be used in conjunction with a medium for displaying the obtained data.

Yet another embodiment of the present invention is directed to a method and apparatus to turn leaves of a material such that data is obtained from an exposed leaf. The apparatus and method include a plurality of transparent leaf turning member pairs. Typically each pair is connected at a top portion. A support member is connected to a corresponding transparent leaf turning member pair and supports the associated transparent leaf turning member pair. A first transparent leaf turning member is positioned on a first portion of a leaf and a second transparent leaf turning member is positioned on a second portion of the leaf. For example, the first leaf turning sheet is placed on the front of a page and the second leaf turning sheet is placed on the back of the page. A drive unit or motor, which is controlled by a motor controller, moves one or more of the support members from a first position to a second position, thereby turning a corresponding leaf of the material.

In this respect it is to be understood that the invention as described herein is not limited in its application to the details of construction and to the arrangements of the components set forth in the following description or illustrated in the drawings. Methods and apparatus consistent with the present invention are capable of other embodiments and of being practiced and carried out in various ways. Also, it is to be understood that the phraseology and terminology employed herein, are for the purpose of description and should not be regarded as limiting.

DETAILED DESCRIPTION OF THE INVENTION

Methods and apparatus consistent with the present invention relate to turning, recording, and reproducing pages or leaves from a material, such as a book, periodical, pamphlet, newspaper, or bound material.

The instant invention has various embodiments. In one embodiment, pages are turned by a leaf or page turning sheet affixed to a corresponding support member Each sheet flips or turns a page of material to enable image data (also referred to herein as images or data) on the page to be exposed. This data can be viewed by a person looking at the text or acquired by a data-obtaining unit. The data-obtaining unit may be a fixed CCD scanner, or an optical device or the like. A typical data obtaining unit may be a photocopier.

Alternatively, a pair of leaf turning sheets may be used to turn a single page. This may be achieved by either placing two leaf turning sheets so as to envelope the page or to use one leaf to turn a sheet while a second leaf secures the material.

Alternatively, in another embodiment, the data-obtaining unit may be a movable contact image sensor that traverses the page thereby acquiring data from the page.

Figure 1A:
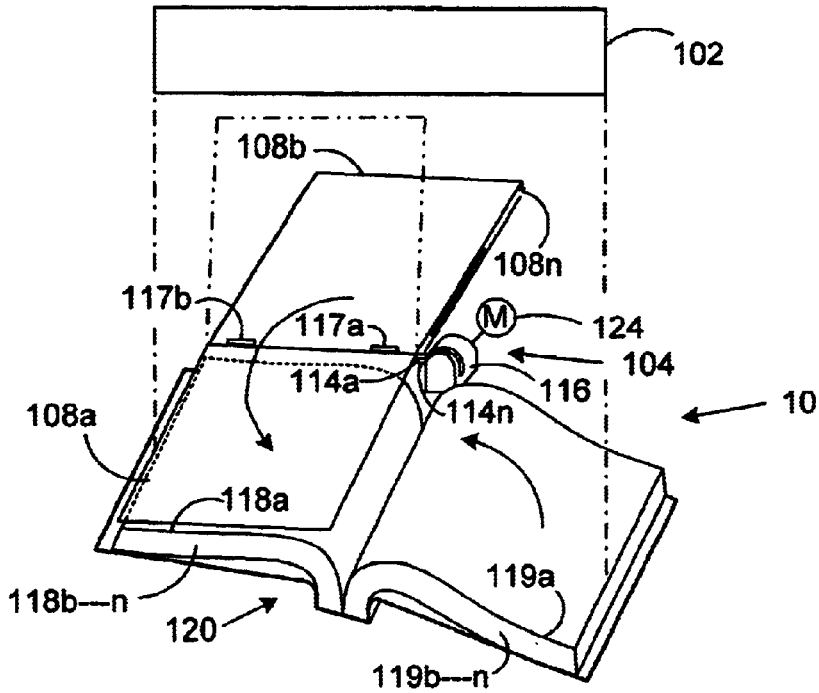
FIGS. 1A, 1B, and 1C show a leaf turning apparatus according to one embodiment of the present invention.
Figure 1B:
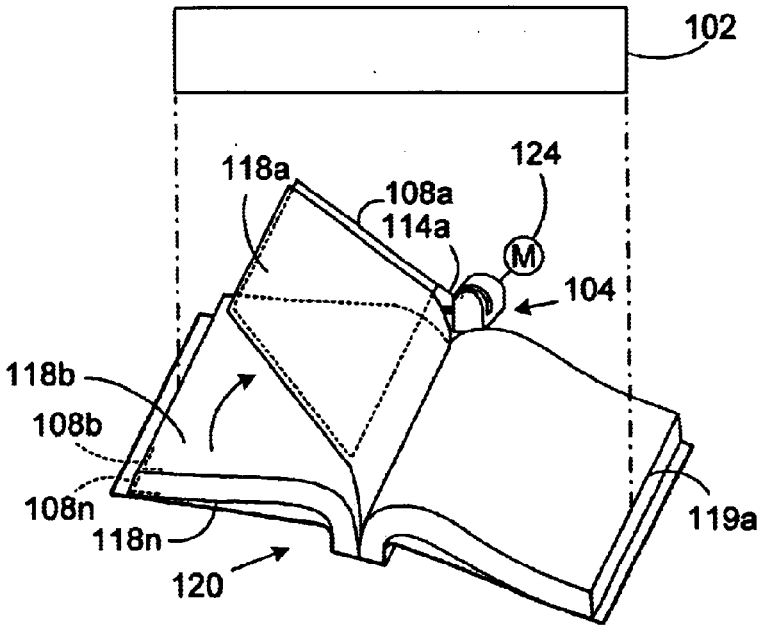
Figure 1C:
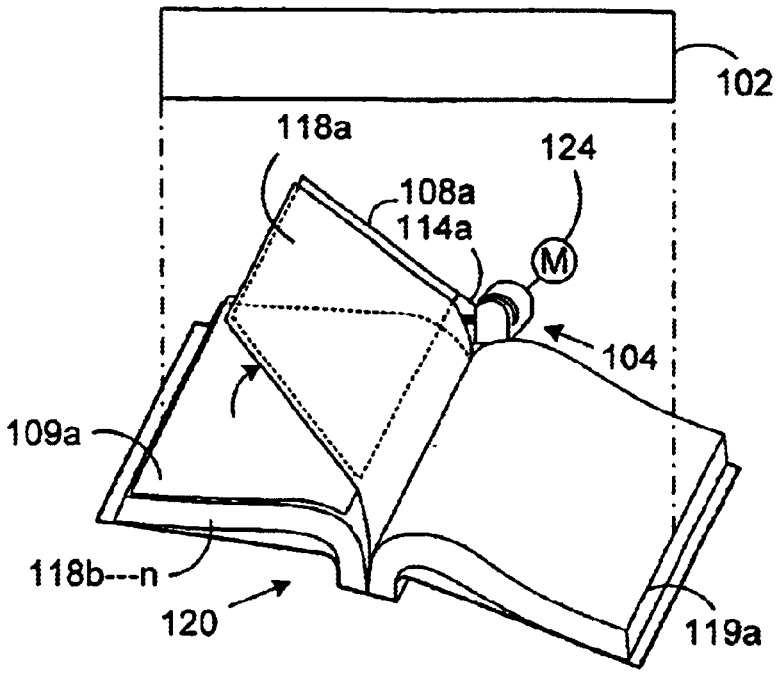

FIGS. 1A, 1B and 1C show an embodiment of an apparatus to turn leaves of a bound volume to expose data thereon. A data-obtaining unit is shown in conjunction with the leaf, or page, turning apparatus.

As shown in FIG. 1A, system 10 includes a leaf moving mechanism 104 that is used to turn or flip pages or leaves containing data.

The leaf moving mechanism 104 includes a plurality of leaf turning members 108(*a*) . . . (*n*) where (n) is any suitable number. Each leaf or sheet or page turning member 108(*a*) . . . (*n*) has a corresponding support member 114(*a*) . . . (*n*), where (n) is any suitable number. The leaf turning members, generally 108, are preferably made of a light-weight flexible thin transparent plastic material or glass or metal material, which have sufficient strength and dimensions to move any leaves 118, 119 of the material 120 without difficulty, no matter the dimensions or composition of the leaves 118, 119 of the material 120. As described herein, leaves 118(*a*) . . . (*n*) (where n is any suitable number) are pages of the material 120 and include text and/or image data. Leaves 118 are positioned on a left-hand side of a material 120 and leaves 119(*a*) . . . (*n*) (where n is any suitable number) are pages of the material that are positioned on a right hand side of a material 120. Of course, the status of leaves 118 and 119 is a function of where the material 120 is opened, and the designation of leaves 118 and 119 is used for descriptive purposes to describe how the pages of material are turned.

Preferably, leaf turning members 108 may be, for example, transparent plastic discs, or oval plates between 1 and 12 inches in length, or transparent plastic sheets with dimensions of approximately 8½"×11". Each support member, generally 114, is coupled to a corresponding leaf turning member 108 and a pivoting mechanism 116 that pivots the support member 114 to enable the leaf turning members 108 to turn leaves 118(*a*) . . . (*n*). This rotation is typically approximately up to one hundred and eighty degrees (180°) in a first direction. Prior to turning a page, the leaf turning member 108 is positioned in the book or material by inserting the leaf turning member 108 between selected pages. A proximal portion of the support member 114 is connected to a motor 124.

The motor or drive unit 124 is typically an A.C. or D.C. motor, or other suitable moving mechanism, that enables the support members 114 to move the pages 118, 119 of the material 120. The specific design requirements are a function of the intended application and are readily apparent to those skilled in the art. Support members 114 are connected to motor 124 such that the support members 114 are able to move sheet members 108 to turn or flip leaves 118, 119 of material 120. The system typically includes a controller microprocessor (not shown) that is programmed to control the motor 124. A conveyor belt or drive belt mechanism (not shown) may be used in conjunction with the motor 124 and support member 114 to move the support member 114 and turn the associated page. Alternatively, any suitable mechanism for turning the page turning members 108 may be used.

Prior to a start of the page turning operation, a user positions the material 120, such as the book, magazine, newspaper, periodical, or multi-page document so that the data-obtaining unit 102 can obtain data from at least one of the leaves 118(*a*) . . . (*n*) and/or 119(*a*) . . . (*n*). The image data that is to be obtained is typically upwardly facing when the data-obtaining unit 102 is disposed above the surface supporting the material 120 to be recorded such as for example, a table or platform (not shown). However, the material 120 may be positioned as required so that the data can be acquired by the data-obtaining unit 102. The user then manually pivots downward each leaf or sheet member 108(*a*), 108(*b*), etc. of the leaf turning mechanism 104, from a non-inserted position to an inserted position. For example, the user inserts sheet member 108(*a*) beneath page 119(*a*), sheet member 108(*b*) beneath page 119(*b*) and so forth for the number of pages the user wishes to turn, scan, photocopy, or otherwise view or obtain data from.

Alternatively, the material 120 may be positioned with the pages facing downward. In this embodiment, the sheet members 108 are inserted between the downward facing sheets and the cover of the book is supported, for example by a shelf. Yet another embodiment is that the material is positioned so as to be supported by the binding. The sheet members 108 are positioned so as to turn the pages.

The data-obtaining unit 102 may be a scanner, camera, or other means for obtaining data. The data obtained by the data-obtaining unit 102 may be reproduced, for example, by an image storage recordation/reproduction device (not shown) such as a computer, photocopier, printer, facsimile device, or may be digitally recorded by the data-obtaining unit 102 for electronic storage or transmission or reproduction on film or paper or conversion to another format (such as optical character recognition or voice synthesis of text).

Alternatively, sheet members 108(*a*), 108(*b*) etc. maybe manually inserted by the user under each of the leaves 118(*a*), 118(*b*) etc. of the material 120 to be turned during the recordation operation. For example, sheet members 108(*a*) maybe placed under upward-facing leaf 118(*a*), which is the first to be recorded, stored and/or reproduced, and sheet members 108(*b*) . . . (*n*) may be placed under all other leaves below e.g. 118(*b*) . . . (*n*), which are to be turned. In this embodiment viewing and/or obtaining data (recordation, storage and/or reproduction) from the leaves 118(*a*) . . . (*n*) occurs in reverse order (i.e., last page to first page).

In an embodiment in which the page turning apparatus has an integrated photocopier device, a user may select the desired number of pages to be turned and/or recorded. When the desired number of leaf turning members, or sheet members 108(*a*) . . . (*n*) have been properly disposed relative to leaves 118 and/or 119, which have been identified for recordation, the user typically enters the number of copies to be made of each page or leaf, initiates the recordation or acquisition process by activating the data-obtaining unit 102 by, for example, pressing the "Start" button, and the recordation operation begins. The data-obtaining unit 102 then proceeds to acquire the data (i.e., scanning, photographing and other known data acquisition techniques) from the exposed upwardly-facing leaves 118, 119 of the material 120 for immediate or later reproduction on paper, storage to an electronic medium such as RAM, ROM, or electronic transmission over a network, communication line or other transmission medium.

As shown in FIG. 1A, a pair of rollers, or attachment rings, 117(*a*) and 117(*b*) are mounted on a corresponding sheet member 108. The roller 117 is used to facilitate movement of the sheet member over surfaces 118, 119. Alternatively, attachment mechanisms may be used to facilitate movement, such as hinges or binder rings.

As shown in FIG. 1B, once recordation or acquisition of the data on the upwardly-facing leaves 118(*a*), 119(*a*) has been performed, the motor 124 moves the support member, 114(*a*) of the uppermost sheet member 108(*a*) disposed under leaf 118(*a*) in the second,direction (i.e., flipped approximately 180° from left to right as shown in FIG. 1B) such that leaf 118(*a*) is flipped, or turned over, onto leaf 119(*a*), exposing new leaves 118(*b*) to be recorded. The leaf member 108(*a*) that is flipped over holds the turned leaf flat, so that recordation of the newly upwardly facing leaves is conducted by the data-obtaining unit 102. The leaves 118(*b*) . . . (*n*) of the material 120 are turned by the leaf turning members 108(*b*) . . . (*n*), which are moved via motor 124 of the leaf moving mechanism 104 until all the leaves 118(*b*) . . . (*n*) which have been designated by placement of leaf turning members 108 have been turned and the data thereon recorded and/or acquired.

It is apparent that the size of the transparent sheet members 108 can vary, from for example 8½×11 inches, to a somewhat smaller size, as long as the transparent leaves are sufficient in size and strength to turn the leaves 118, 119 of the material 120.

FIG. 1C shows an alternate embodiment in which each sheet member includes a plurality of leaf pairs 108(*a*) . . . (*n*) and 109(*a*) . . . (*n*) (where n is any number) that can be used such that a lead leaf 108(*a*) turns a page and a following leaf 109(*a*) holds the material in position while data is obtained. The embodiment shown in FIG. 1C is also suitably used in conjunction with a data-obtaining unit 102. Although FIG. 1C only shows one pair, 108(*a*), 109(*a*), additional pairs may also be used. Thus, this embodiment shows that two leaves 108(*a*) and 109(*a*) may be used to turn a single page 118(*a*) and to hold the material 120 in position. Other elements described in relation to FIG. 1A and FIG. 1B are shown but not described.

Figure 2:
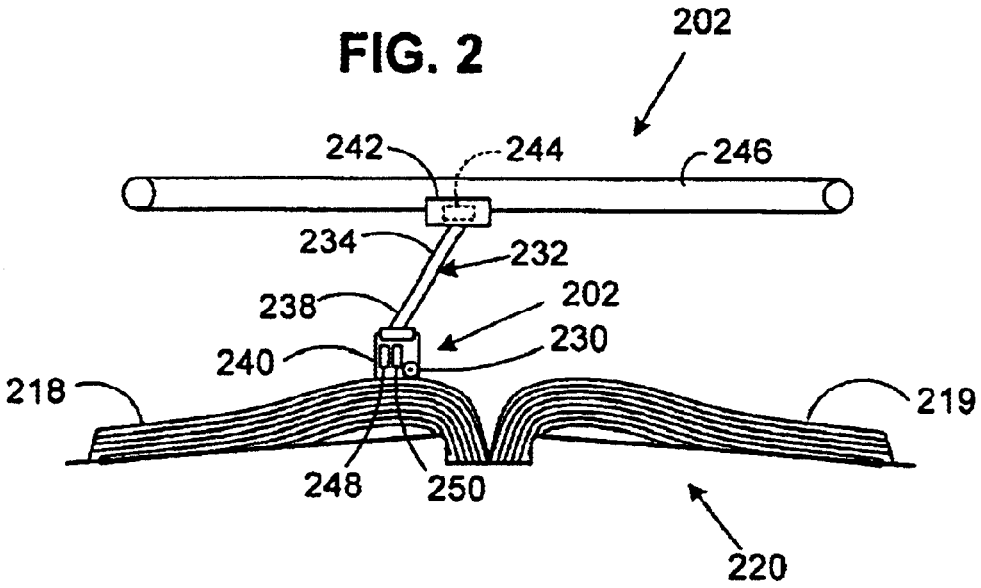
FIG. 2 shows a data obtaining unit used with the present invention.
Figure 4:
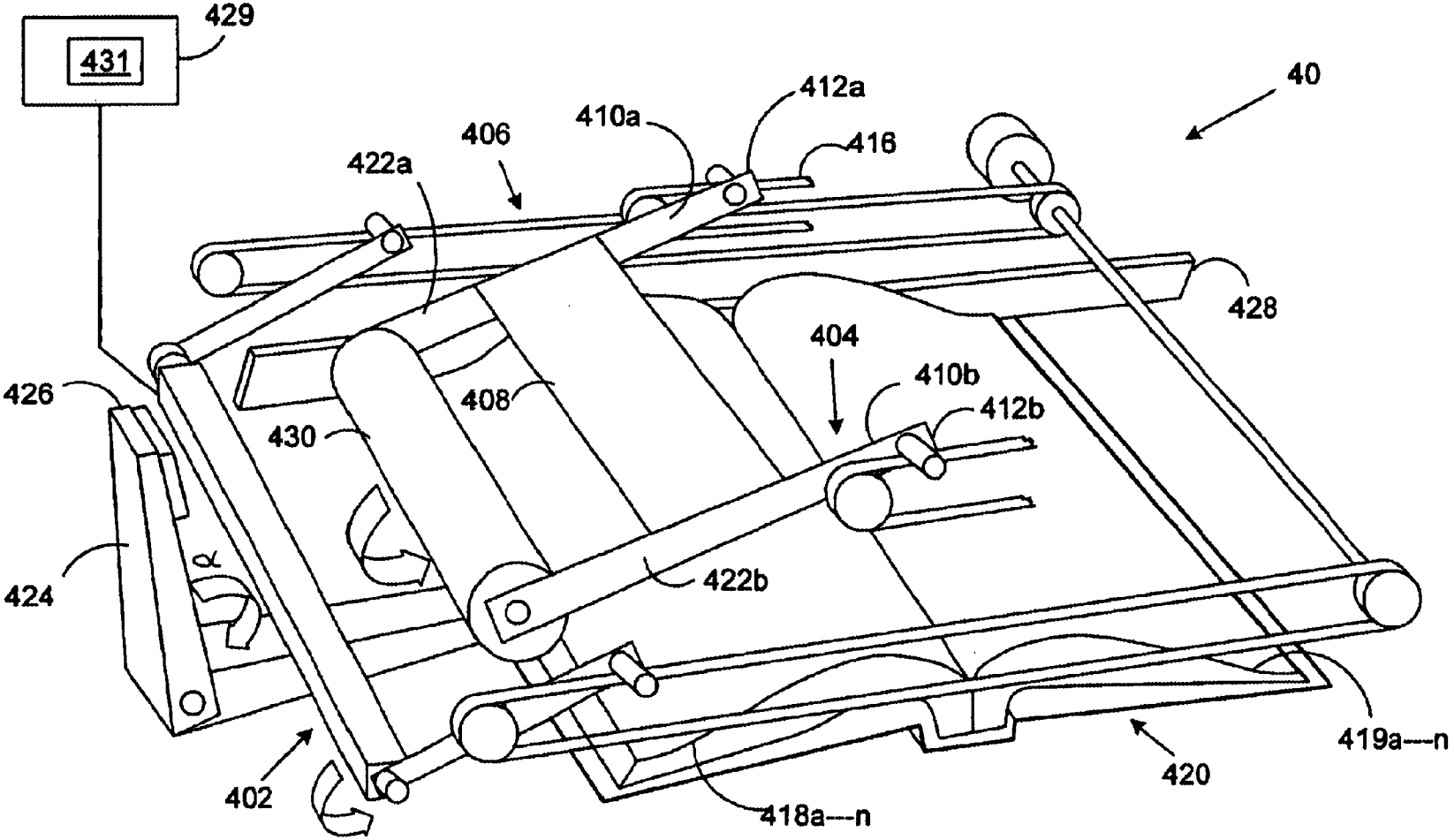
FIG. 4 shows a leaf turning apparatus according to a second embodiment of the present invention.

FIG. 2 shows a data-obtaining unit 202 that may be used in conjunction with a leaf turning mechanism (described above as element 104). The movable data-obtaining unit 202 obtains data from leaves 218, 219 of material 220. Movable data-obtaining unit 202 may be coupled to a data storage unit or data reproduction unit, such as a photocopier, printer, computer or facsimile machine (not shown). The movable data-obtaining unit 202 is adapted to reduce distortion, foreshortening, and image degradation of the data obtained from material 220. The movable data-obtaining unit 202 includes a pivotable image sensor 240 supported by at least one, but typically a pair of supporting arms. (FIG. 2 shows a single arm 232, and FIG. 4 shows two arms). The supporting arm 232 has proximal portion 234 and distal portion 238. Distal portion 238 of the supporting arm 232 includes the image sensor 240. The first support mechanism 246 is coupled to a lift and lowering mechanism 242 having a pivoting mechanism 244 that pivots the supporting arm 232, such that the arm 232 lifts the image sensor 240 from the leaves 218, 219 of the material 220 after recordation, and which lowers the image sensor 240 onto the leaves 218, 219 of the material 220 for recordation. The pivoting mechanism 244 of the lift and lowering mechanism 242 is disposed on a carriage transport drive 246.

The carriage transport drive 246 is coupled to a motor (not shown), and is used to facilitate the movement of image sensor 202 through a desired path of motion. The motor may be coupled to a microprocessor that is programmed with logic control to control the motor.

The image sensor 240 may include a photodetector, an alignment of rasterizer chips, a rod lens (e.g., a SELFOC™ lens), and a plurality of light-emitting diodes (LED's). Disposed at one end of the image sensor 240 is an encoder wheel and sensor attached to a roller, which may be an elastomeric roller, the encoder wheel and sensor 230 tracks a distance traveled by the image sensor 240 on the material 220, in order to trigger recording by the image sensor 240 at a designated displacement.

The image sensor 240 can vary in length, but for the highest efficiency, in order to prevent multiple passes over each leaf 218, 219, the image sensor 240 is approximately at least the height of each of the leaves of the material 220 such that scanning of the leaves 218, 219 can be performed during one scanning pass.

Thus, the movable data-obtaining unit 202 may be used in conjunction with the leaf moving mechanism, described above, to obtain data from pages, as pages are turned. The leaf turning motor described as element 124 in relation to FIGS. 1A and 1B is typically coordinated with the data-obtaining motor so that as the pages are turned, the data is obtained from the pages.

Although FIGS. 1A, 1B, and 1C show the leaf turning mechanism 104 of the present invention being used with a self-contained or stationary data-obtaining unit 102, and FIG. 2 shows a movable data-obtaining unit 202 for the recordation of data from the material 220, the leaf turning mechanism 104 as described herein may also be used without a data-obtaining unit to turn the leaves 118, 119 of a material 120 for any reason where remote turning of the leaves is required (e.g., for handicapped users or for turning sheet music for a pianist). In that case, the sheet members 108(*a*) . . . (*n*), or in the case of the embodiment using a plurality of leaf pairs 108, 109, the leaf members are inserted under leaves that the user wishes the leaf turning mechanism 104 to turn.

FIGS. 3A–3G show a lift and lowering process of a movable data-obtaining unit 302 in which the data obtaining unit turns the leaves or pages and also obtains data that may be reproduced, stored, transmitted or photocopied. Upon initiation of the recordation operation, the lift and lowering mechanism 342 lowers or pivots the supporting arms 332 of the data-obtaining unit 302 from a rest position 370. The lift and lowering mechanism 342 is coupled to a carriage transport drive 346. As shown in FIGS. 3A–3G the carriage transport drive 346 moves the data-obtaining unit, also referred to as an image sensor 302, across upwardly facing leaves 318, 319 to capture image and or text data printed on leaves 318, 319.

Figure 3A:
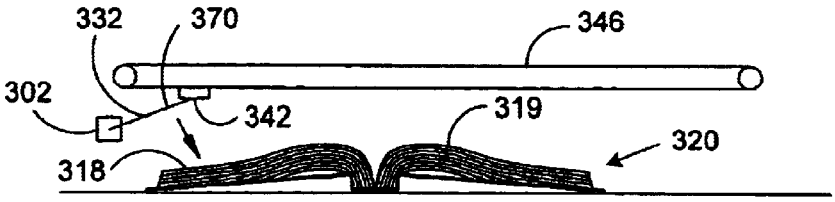
FIGS. 3A–3G show a movable data-obtaining unit.

FIG. 3A shows that support arm 332, moves from a rest position 370 to a position where the image sensor is in contact or slightly above the text/image data to be acquired. Carriage transport drive 346, lift and lowering mechanism 342 and material 320 are also shown.

Figure 3B:
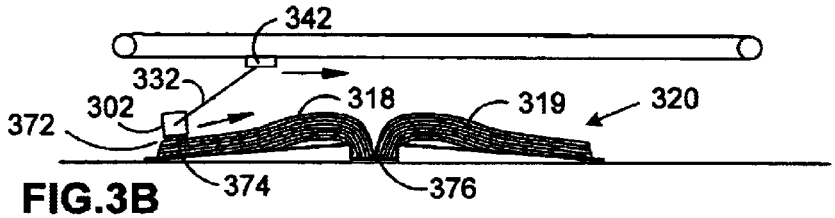

FIG. 3B shows that the image sensor 302 is placed at an initial position 372 on the first leaf 318 of the two upwardly facing leaves 318, 319 of the material 320. The initial position 372 is where the image sensor 302 is in direct contact with the first upwardly facing leaf 318 of the material 320 to be recorded, at a left side of the material 320, and at an outer edge thereof. The image sensor 302 is pivotable with respect to the supporting arm 332, such that the image sensor 302 is placed in essentially flat contact with the leaf 318 of the material 320. The data obtaining operation begins when the image sensor 302 begins moving to the right across leaf 318, with the encoder wheel and sensor, (described in relation to FIG. 2) triggering data obtaining at each completion of incremental traversal of a designated distance. Obtaining the data on leaf 318 ensues, with the image sensor 302 following the contours of the material 320.

During data acquisition, the image sensor 302 pivots and rotates freely with respect to the supporting arm 332 such that an imaging facet 374 of the image sensor 302 follows the contour of the leaf 318 (which typically begins at an incline and then curves downwardly near the spine, fold, or bound edge 376), and remains in essentially flat contact with the upwardly-facing leaves 318, 319 of the material 320. Thus, the encoding wheel, remains in contact with the surface of the leaf being imaged 318, 319 and it sends signals to the logic circuit (not shown) to trigger the rastering of data from the image sensor 302 as a function of the linear distance moved across the curved surface of the leaf 318. This reduces distortion of the images near the spine 376 of the material 320.

Figure 3C:
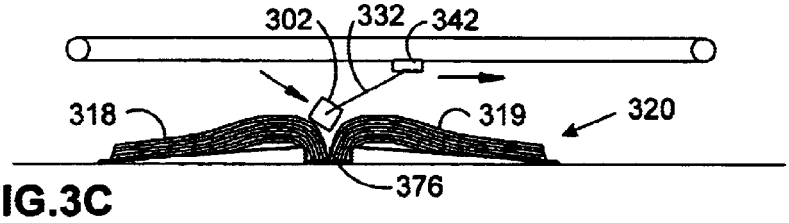

As shown in FIG. 3C, when the image sensor 302 has completed recordation of data on the first leaf 318, and reaches the spine 376 of the material 320, the image sensor 302 has experienced some rotation.

Figure 3D:
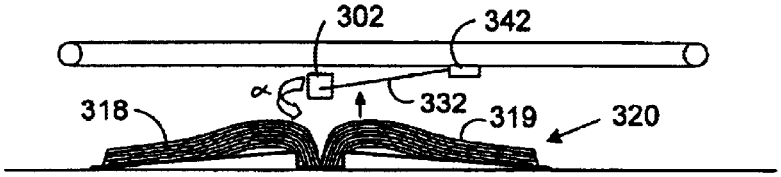

As shown in FIG. 3D, while between the two leaves 318 and 319, the left to right recordation or scanning motion of the image sensor 302 is temporarily halted while the lift and lowering mechanism 342 raises the supporting arms 332 and lifts the image sensor 302 out of contact with the surface of leaf 318.

Figure 3E:
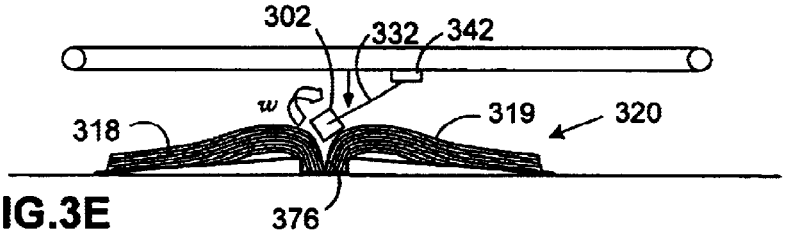
Figure 3F:
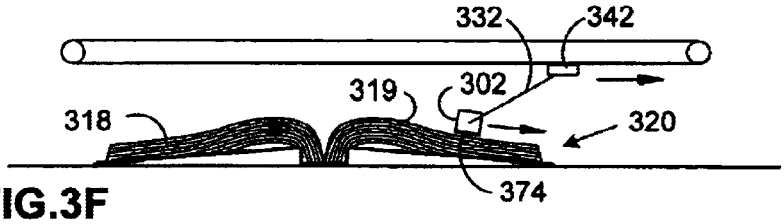

As shown in FIGS. 3E and 3F, the lift and lowering mechanism 342 lowers the supporting arm 332 onto the leaf 319 near the spine. The image sensor is rotated such that the image facet 374 becomes tangential to the curved surface of the leaf 319. The imaging facet 374 of the image sensor 302 is placed in contact with the contour of leaf 319 of the material 320, and acquisition of data on leaf 319 continues. As discussed above, the image sensor 302 is pivotable such that it remains in flat contact and conforms to the contour of leaf 319. As stated above, the encoder wheel and the image sensor 302, which are in flat contact with the leaves of the material 320, allow acquisition of the data to be performed without substantial distortion, foreshortening, or degradation of the data.

Figure 3G:
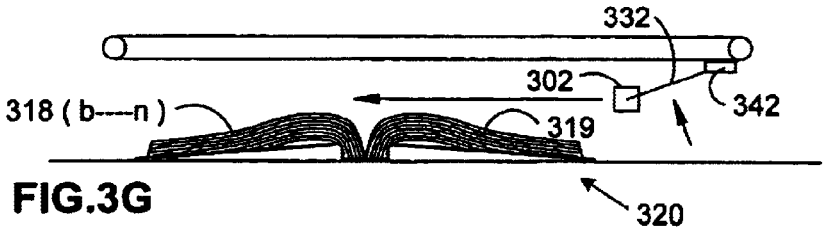

As shown in FIG. 3G, when the encoder wheel and sensor has detected that there is no more data, or when the carriage transport drive has reached the end of its path, the image sensor 302 is lifted by the lift and lowering mechanism 342 and returned to the rest position 370 above material 320. If the data of additional leaves 318(*b*) . . . (*n*) are to be obtained, the data obtaining operation is repeated until all the leaves identified are complete. Reproduction of the data can take place immediately or at a later time depending on the reproduction device used (e.g., photocopier, camera system etc.). The data may also be stored electronically such as in computer memory, server location, facsimile memory or transmitted electronically to a remote location.

FIG. 4 shows an embodiment 40 of the invention in which the leaf moving mechanism 404 includes a leaf acquisition mechanism 406 and a movable data-obtaining unit 402.

The leaf acquisition mechanism 406 includes a support mechanism 408 having at least one, but preferably a pair of supporting arms 410(*a*) and 410(*b*) generally 410. The supporting arms 410(*a*) and 410(*b*) have proximal portions 412(*a*) and 412(*b*), respectively which are pivotably attached to a carrier transport drive 416. Supporting arms 410(*a*) and 410(*b*) have distal portions 422(*a*) and 422(*b*), respectively, which, are coupled to a leaf turning mechanism 430. The leaf turning mechanism 430 is, for example, a vacuum roller. Alternatively, the leaf turning mechanism 430 can temporarily adhere the leaves 418, 419. For example in this situation, the leaf turning mechanism 430 is suitably a roller with an adhesive tape or a static electric charge. Other examples include tabs or hooks (not shown) that attach to the page or leaf to be turned.

A leaf tensioning foot mechanism 424 is disposed at one edge of the material 420, and pivots from an initial position 426 at an angle $\alpha$ onto the material 420 to exert a normal force on the edge of leaves 418, which are located on the left hand side of the material 420 (i.e., where recordation starts) such that the leaves 418 are held in place during the data obtaining process.

Further, a material registration edge device 428 provides a boundary for placement of the material 420, such that the material 420 is properly placed for recordation by the data-obtaining unit 402.

The data-obtaining unit 402 may be coupled to a data storage unit, such as an electronic memory, or a data reproduction unit such as a photocopier machine or facsimile machine (not shown).

The movable data-obtaining unit 402 is used to acquire data from material 420 and then transmit the acquired data for subsequent processing.

In an alternate embodiment, the leaf turning mechanism 404 may have, or may be coupled to, a memory for storing the desired number of pages to be copied. When the inputted number of pages have been turned, the page turning mechanism 404 will terminate operation. Also, a user can enter into an associated photocopier machine, facsimile machine or other device (not shown) the number of copies desired and the associated machine can control the leaf moving mechanism 404 to turn or flip the desired number of pages.

It will be noted that within a recordation and reproduction operation, a user may desire to record any number of leaves in a bound material that are separated by any number of intervening leaves. It will further be noted that the device of the present invention may be coupled to a microprocessor 429 with memory 431 that can be configured to allow input of the number of leaves or pages of the material from which data is to be obtained. The microprocessor 429 can calculate the pages from which data is to be obtained and the pages that are to be turned without data being obtained therefrom. A memory 431 can store the specific pages or leaves from which data is to be obtained 418(*a*) . . . (*n*), 419(*a*) . . . (*n*), and number of intervening leaves or pages, for example, 418(*b*) . . . (*d*) 419(*b*) . . . (*d*) to be turned without a data-obtaining operation. Upon the data-obtaining device 402 obtaining data from page or leaf 418(*a*), the leaf turning mechanism 404 will then proceed to lift and turn the intervening pages or leaves 418(*b*) . . . (*d*). After having lifted and turned the last intervening leaf to be turned 418(*d*), the data-obtaining device 402 will obtain data from the leaf 418(*e*), and the page turning mechanism 404 will continue the recordation operation with the data-obtaining unit 402 through to leaf 418(*g*). For example, if the user desires to copy pages 10, 20, and 30–35 in a book. The user enters the page numbers 10, 20, and 30–35, into the device, indicating page 10 is the first page from which data is to be obtained in the operation. The microprocessor 429 calculates to begin the data obtaining operation with page 10; lifts and turns, but does not obtain data from, pages 11–19; upon reaching page 20, the data obtaining unit 402 then obtains data from that page; lifts and turns, but does not record, pages 21–29; upon reaching page 30, the data obtaining unit 402 then obtains data from that page and continues to obtain data from the identified pages 30–35.

FIGS. 5A–51 show operation of the leaf moving mechanism 504 in conjunction with a data-obtaining unit 502, adapted to obtain data from leaves 518, 519 of material 520. As the leaf moving mechanism 504 lifts or acquires pages, data-obtaining unit 502 obtains data.

Figure 5A:
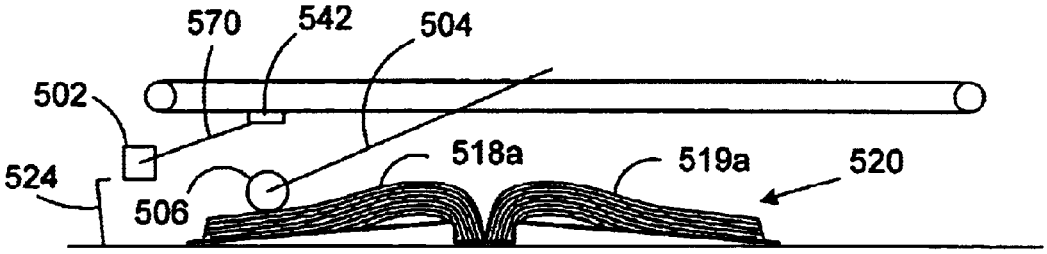
FIGS. 5A–5I show a leaf turning operation and a data recordation operation.

As shown in FIG. 5A, upon completion of the data acquisition operation on the two leaves 518(*a*), 519(*a*), the data-obtaining unit 502 is lifted by the lift and lowering mechanism 542 and returned to the rest position 570, above the material 520.

Figure 5B:
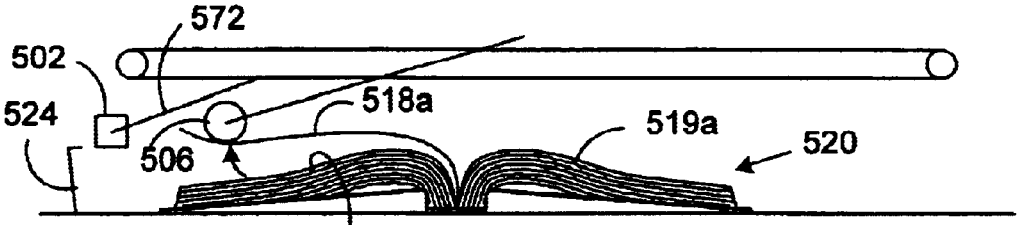

As shown in FIG. 5B, once the leaf 518(*a*) is acquired, the leaf acquirement mechanism 506 may move slightly to the right before lifting leaf 518(*a*) in order to separate the leaf 518(*b*) underneath and insure that leaf 518(*b*) does not lift with leaf 518(*a*). After the leaf acquisition mechanism 506 acquires leaf 518(*a*), it moves the leaf 518(*a*) vertically away from the underlying leaf 518(*b*) so that there is a sufficient space in between leaf 518(*a*) and 518(*b*) for the data-obtaining unit 502 to be placed into an initial position 572 between leaf 518(*a*) and 518(*b*) as shown below in FIG. 5C.

Figure 5C:
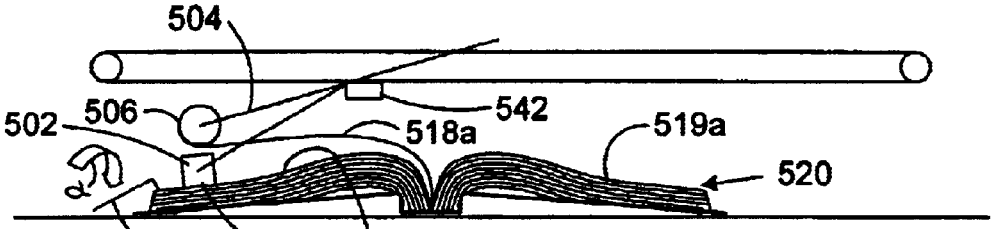

As shown in FIG. 5C, the leaf tensioning foot mechanism 524 is pivoted to contact the material 520 to exert a force on the material.

Figure 5D:
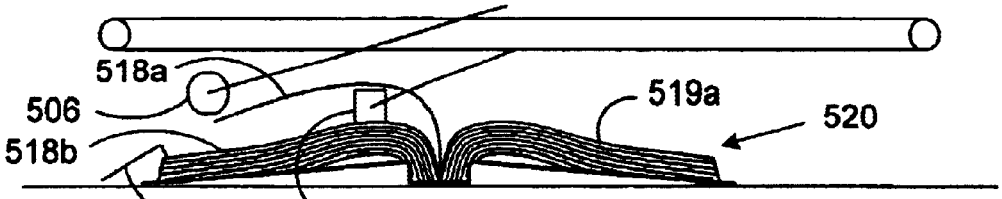

As shown in FIG. 5D, the lifted leaf 518(*a*) is released by the leaf acquisition mechanism 506 (e.g., by the vacuum being turned off if it is a vacuum roller), and data acquisition begins. In an embodiment in which the leaf acquisition mechanism 506 includes an adhering mechanism, the movement of the data-obtaining unit 502 across the leaf 518(*b*) in the scanning operation, will pull leaf 518(*a*) from the leaf acquisition mechanism 506 and release the leaf 518(*a*). Any other means to release the leaf 518(*a*) can also be used, such as rotating the leaf acquisition mechanism 506 such that the leaf 518(*a*) no longer adheres to the acquisition mechanism.

Figure 5E:
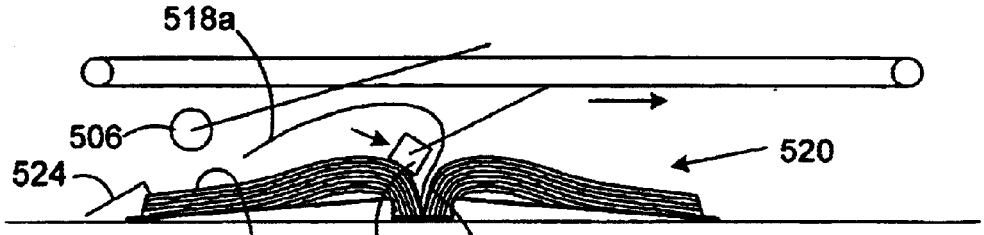
Figure 5F:
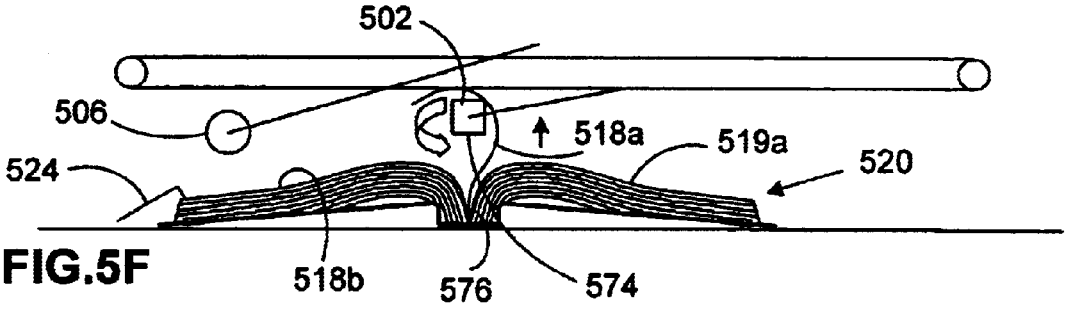

As shown in FIGS. 5E and 5F when the data-obtaining unit 502 is at a center of the material 576, the data-obtaining unit 502 is temporarily halted while the supporting arms 510 lifts the data-obtaining unit 502 out of contact with leaf 518(*b*). This enables the image sensor 502 to rotate such that its imaging facet returns to an essentially horizontal position, and is facing essentially, directly downward.

When the data-obtaining unit 502 moves rightward, and then is lifted at the center of the material 576, the data-obtaining unit 502 assists in turning the lifted leaf 518(*a*) onto leaf 519(*a*).

Figure 5G:
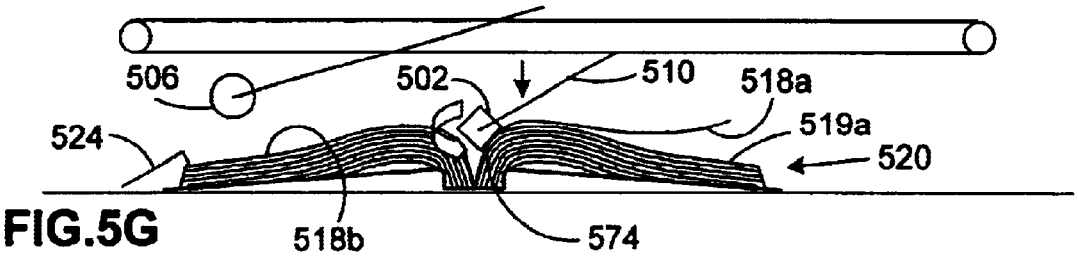

As shown in FIG. 5G, after the data-obtaining unit 502 is lifted and rotated, the supporting arm 510 then lowers the data-obtaining unit 502 back onto the underside of leaf 518(*a*), which is now turned and facing upward, enabling the data-obtaining unit 502 to rotate such that its imaging facet is in contact with the contour of the material 520 (i.e., on the underside of leaf 518(*a*)), such that the data-obtaining unit 502 can continue acquiring the data. Thus, what was the underside of the previously lifted leaf 518(*a*), now becomes the side of the leaf being imaged as the data-obtaining unit 502 continues its rightward scan, along the contours of the surface of the material 520. It is apparent that upon completion of the flipping or turning of the leaf 518(*a*), it is on the opposite side of the center of the material 576, thus it becomes one of the leaves represented by 519 in FIG. 5. It will be noted that positional language such as "upward", "underside", "right", and "left" are not intended to limit the invention to those positions, and are only used as an aid in describing the embodiments herein described.

An encoding wheel (not shown), resumes sending signals to the logic circuit (not shown) to trigger the rastering of data received by the data-obtaining unit 502 as a function of linear distance moved across the curved surface of the upwardly-facing leaves 518, 519 of the material 520, thus, continuing to reduce distortion due to the contour of the surface of the leaf 518, 519.

Figure 5H:
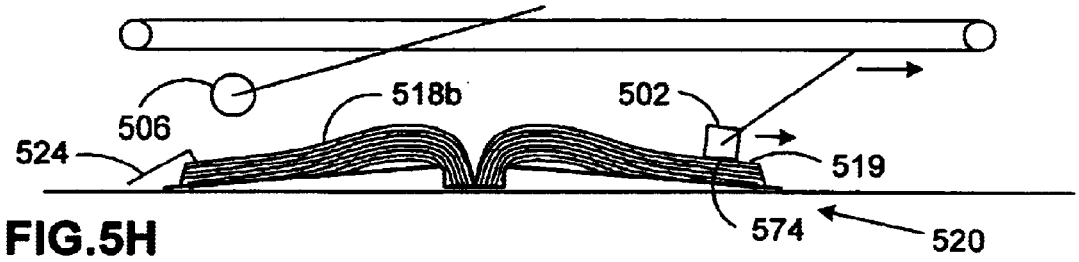
Figure 5I:
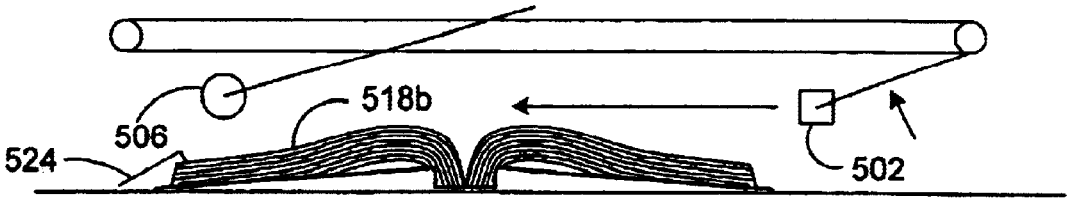

As shown in FIG. 5H the data-obtaining unit 502 continues its scanning motion, pivoting and rotating to conform to the contours of the material 520, until the encoder wheel no longer receives data to trigger scanning by the data-obtaining unit at the right edge of the material 520.

FIG. 51 shows that once data acquisition has ceased the data-obtaining unit 502 is removed from the surface of former leaf 518(*a*), which is now 519 and reverses direction, to move leftward until it arrives once more in the rest position.

If leaf 518(*b*) is to be turned, then the process begins again, until all the leaves 518(*b*) . . . (*n*), identified by the user have been recorded for further reproduction.

Another embodiment of the invention is one in which the leaf moving mechanism includes a leaf acquisition mechanism as described in detail in FIGS. 4 and 5 and a fixed data-obtaining unit as described in FIG. 1. In this embodiment, since the data-obtaining unit is not attached or otherwise disposed upon the support arms there is instead a leaf moving device that performs a similar page turning function as that performed by the data-obtaining unit 504 as shown in FIG. 5. Upon the completion of a leaf being moved and disposed onto a second leaf in a manner similar to that as shown in herein, recordation of the newly upwardly-facing leaves is conducted by the data-obtaining unit in a manner similar to that as performed by the data-obtaining unit as shown by element 102 in FIG. 1.

Figure 6:
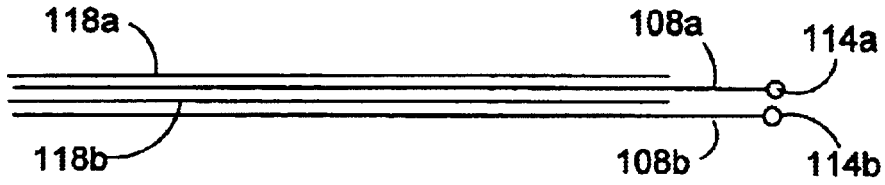
FIG. 6 shows a cross-sectional view of leaf turning sheets between pages.

FIG. 6 shows a cross-sectional view of page turning sheets 108(*a*) and 108(*b*) inserted between a corresponding page 118(*a*), 118(*b*) of material. The corresponding support arms 114(*a*) and 114(*b*) are also shown.

Figure 7:
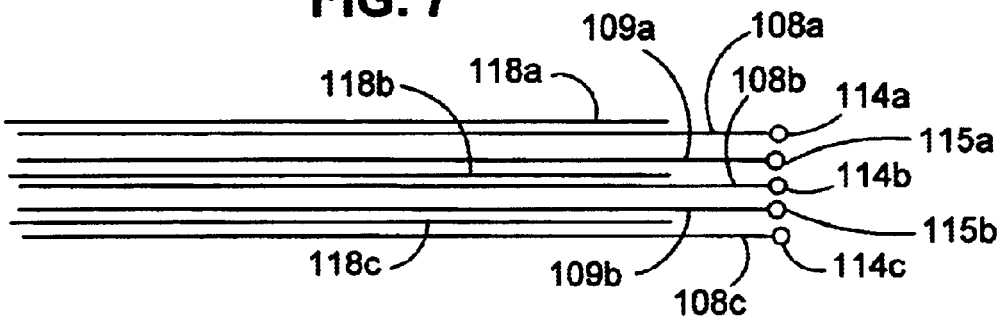
FIG. 7 shows a cross-sectional view of two leaf turning sheets between each page.

FIG. 7 shows a cross-sectional view of two page turning members used in conjunction with each other. Page turning members 108(*a*) and 109(*a*) are positioned beneath page 118(*a*). Member 108(*a*) is coupled to arm 114(*a*) and member 109(*a*) is coupled to arm 115(*a*). Member 108(*a*) is used to turn page 118(*a*) and member 109(*a*) is used to hold the underlying pages in place. Page turning members 108(*b*) and 109(*b*) are positioned beneath page 118(*b*). Member 108(*b*) is coupled to arm 114(*b*) and member 109(*b*) is coupled to arm 115(*b*). Page turning member 108(*c*) is positioned beneath page 118(*c*).

Figure 8:
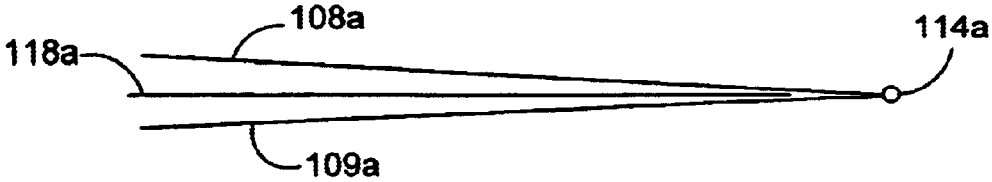
FIG. 8 shows a cross-sectional view of two leaf turning sheets surrounding a page.

FIG. 8 shows an embodiment in which members 108(*a*) and 109(*a*) envelop page 118(*a*). Both members 108(*a*) and 109(*a*) are connected to support arm 114(*a*). In this embodiment, the members 108 and 109 are moved to turn the page 118(*a*). Similar pairs of members are used to restrain and turn additional pages.

While methods and apparatus consistent with the present invention have been particularly shown with reference to the above embodiments, it will be understood by those skilled in the art that various other changes in the form and details may be made therein without departing from the spirit and the scope of the invention.

What is claimed is:

1. An apparatus adapted to turn leaves of a material having a plurality of leaves, comprising:

a plurality of transparent leaf turning sheet pairs, each transparent leaf turning sheet pair has a first transparent leaf turning sheet and a second transparent leaf turning sheet, wherein each transparent leaf turning sheet pair is inserted between two leaves of the material prior to Initiating a leaf turning operation;

a plurality of support members, each support member connected to a corresponding transparent leaf turning sheet member, each support member adapted to support the associated transparent leaf turning sheet member;

a drive unit adapted to move one or more of the support members from a first position to a second position, thereby turning one of the transparent leaf turning sheet members of a pair so that the first transparent leaf turning sheet member turns a first leaf of the material and the second transparent leaf turning sheet member is in contact with a second leaf of the material;

a data-obtaining unit, adapted to obtain data from an exposed leaf of the material;

wherein the data-obtaining unit comprises;

at least one supporting arm having a proximal portion and a distal portion; and an image sensor mounted on the distal portion of the supporting arm;

wherein the image sensor is adapted to obtain data from an exposed leaf of the material.

2. The apparatus as claimed in claim 1 wherein the data-obtaining unit is mounted in proximity to the material.

3. The apparatus according to claim 2, wherein the data-obtaining unit includes a photocopier.

4. The apparatus according to claim 2, wherein the data-obtaining unit includes a printer.

5. The apparatus according to claim 2, wherein the data-obtaining unit includes a facsimile machine.

6. The apparatus according to claim 2, wherein the data-obtaining unit electronically stores the data.

7. An apparatus adapted to turn leaves of a material having a plurality of leaves, comprising:

a plurality of transparent leaf turning sheet pairs, each transparent leaf turning sheet pair has a first transparent leaf turning sheet and a second transparent leaf turning sheet, wherein each transparent leaf turning sheet pair is inserted between two leaves of the material prior to initiating a leaf turning operation;

a plurality of support members, each support member connected to a corresponding transparent leaf turning sheet member, each support member adapted to support the associated transparent leaf turning sheet member;

a drive unit adapted to move one or more of the support members from a first position to a second position, thereby turning one of the transparent leaf turning sheet members of a pair so that the first transparent leaf turning sheet member turns first leaf of the material and the second transparent leaf turning sheet member is in contact with a second leaf of the material; and a data-obtaining unit, adapted to obtain data from an exposed leaf of the material. wherein the data-obtaining unit further comprises an encoder wheel attached to a roller, the roller being disposed at a first portion of an image sensor and determines a distance traveled by the image sensor on the material.

8. An apparatus adapted to turn leaves of a material having a plurality of leaves, comprising:

a plurality of transparent leaf turning sheet pairs, each transparent leaf turning sheet pair has a first transparent leaf turning sheet and a second transparent leaf turning sheet, wherein each transparent leaf turning sheet pair is inserted between two leaves of the material prior to initiating a leaf turning operation;

a plurality of support members, each support member connected to a corresponding transparent leaf turning sheet member, each support member adapted to support the associated transparent leaf turning sheet member;

a drive unit adapted to move one or more of the support members from a first position to a second position, thereby turning one of the transparent leaf turning sheet members of a pair so that the first transparent leaf turning sheet member turns a first leaf of the material and the second transparent sheet member is in contact with a second leaf of the material;

a leaf tensioning member adapted to exert pressure on a portion of the material.

9. An apparatus adapted to turn leaves of a material having a plurality of leaves, comprising:

a plurality of transparent leaf turning sheet pairs, each transparent leaf turning sheet pair has a first transparent leaf turning sheet and a second transparent leaf turning sheet, wherein each transparent leaf turning sheet pair is inserted between two leaves of the material prior to initiating a leaf turning operation;

a plurality of support members, each support member connected to a corresponding transparent leaf turning sheet member, each support member adapted to support the associated transparent leaf turning sheet member;

a drive unit adapted to move one or more of the support members from a first position to a second position, thereby turning one of the transparent leaf turning sheet members of a pair so that the first transparent leaf turning sheet member turns a first leaf of the material and the second transparent leaf turning sheet member Is in contact with a second leaf of the material;

an attachment ring affixed to a corresponding support member.

10. A method of turning pages of a material, comprising the steps of:

positioning the material such that two pages of the material are exposed wherein the positioning step further comprises;

pivoting a leaf tensioning foot mechanism onto a portion of the pages of the material such that the leaf tensioning foot mechanism exerts a normal force on the portion of the pages.

inserting a pair of transparent leaves under a selected page of the material;

moving a first transparent leaf such that the selected page is turned;

maintaining a position of a second transparent leaf such that the second transparent leaf remains in contact with a second page that is underneath the selected page.

11. An apparatus for turning leaves of a material comprising:

a plurality of transparent sheet members, each sheet member adapted to move one leaf of the plurality of leaves of the material that contains data;

a plurality of support members, each support member connected to a corresponding sheet member;

a drive unit adapted to move each of the support members from a first position to a second position, thereby turning a corresponding one of the transparent sheet members so that the transparent sheet member turns a corresponding leaf of the material;

a data-obtaining unit, adapted to obtain the data from an exposed leaf of the material, the data-obtaining unit includes:

at least one supporting arm having a proximal portion and a distal portion; and an image sensor mounted on the distal portion of the supporting arm, wherein the image sensor is adapted to obtain data from an exposed leaf of the material.

12. The apparatus according to claim 11, wherein the data-obtaining unit is mounted In proximity to the material.

13. The apparatus according to claim 11, wherein the image sensor of the data-obtaining unit comprises a series of photodetectors, a rasterizer, a lens and an illuminator.

14. An apparatus adapted to turn leaves of a material having a plurality of leaves, comprising:

a plurality of transparent leaf turning member pairs;

a plurality of support members, each support member connected to a corresponding transparent leaf turning member pair, adapted to support the associated transparent leaf turning member pair, wherein a first transparent leaf turning member is positioned on a first portion of a leaf and a second transparent leaf turning member is positioned on a second portion of the leaf; and a drive unit adapted to move one or more of the support members from a first position to a second position, thereby turning a corresponding leaf of the material;

a data-obtaining unit, adapted to obtain data from an exposed leaf of the material;

at least one supporting arm having a proximal portion and a distal portion; and an image sensor mounted on the distal portion of the supporting arm;

wherein the image sensor is adapted to obtain data from an exposed leaf of the material.

15. The apparatus as claimed in claim 14 wherein the data-obtaining unit is mounted in proximity to the material.

* * * * *